United States Patent [19]

Sjoman et al.

[11] 3,980,290

[45] Sept. 14, 1976

[54] TOWEL FOLDER

[75] Inventors: Carl F. Sjoman, Los Angeles; Edward L. McClain, Inglewood, both of Calif.

[73] Assignee: Team Industries, Los Angeles, Calif.

[22] Filed: Aug. 17, 1973

[21] Appl. No.: 389,365

Related U.S. Application Data

[63] Continuation of Ser. No. 215,843, Jan. 6, 1972, abandoned.

[52] U.S. Cl. ..... 270/66; 270/86

[51] Int. Cl.[2] ..... B65H 45/16

[58] Field of Search ..... 270/64, 66, 86, 94; 38/143; 271/15, 17

[56] References Cited

UNITED STATES PATENTS

| | | | |
|---|---|---|---|
| 1,827,336 | 10/1931 | Sager | 38/143 |
| 2,887,313 | 5/1959 | Malott | 270/66 X |
| 3,204,353 | 9/1965 | Hajos | 270/66 X |
| 3,452,979 | 7/1969 | Grantham | 270/62 |
| 3,462,138 | 8/1969 | Grantham | 270/67 X |
| 3,642,270 | 2/1972 | Patton | 270/62 |

*Primary Examiner*—Robert E. Bagwill
*Assistant Examiner*—A. Heinz
*Attorney, Agent, or Firm*—Harris, Kern, Wallen & Tinsley

[57] ABSTRACT

An apparatus for quarter or French folding towels, or the like. When quarter folding, a single, central longitudinal fold is made by conveying one side of the towel into engagement with one of two oppositely oriented, diagonal folding blades. When French folding, opposite sides of the towel are conveyed into engagement with the respective folding blades. The longitudinal folds are made around laterally spaced forms one of which is movable laterally toward or away from the other, the spacing of the forms depending on the width of the towel and also depending on whether the towel is being French or quarter folded. (If the towel is being quarter folded, the spacing of the outer edges of the forms is one-half the towel width, and, if the towel is being French folded, this spacing is one-third the towel width.) Alternatively usable inlet guides at the inlet end of the longitudinal folding mechanism guide the towel thereto in a laterally offset position for quarter folding, or a laterally centered position for French folding. The forms are longitudinally corrugated. After being folded longitudinally in either of the foregoing ways, the towel is cross folded by inserting a central lateral zone thereof between upper and lower cross folding belts. The upper cross folding belt is capable of floating vertically to accommodate towels of varying thicknesses.

5 Claims, 18 Drawing Figures

TOWEL FOLDER

This application is a continuation of our application Ser. No. 215,843, filed Jan. 6, 1972, and now abandoned.

BACKGROUND OF THE INVENTION

The present invention relates in general to an apparatus for folding rectangular articles and, since the invention is particularly applicable to a machine for folding towels, it will be considered in such connection herein for convenience.

More specifically, the invention relates to an apparatus for longitudinally and laterally or cross folding towels, or the like. Still more specifically, the invention relates to an automatic machine for longitudinally and cross folding towels, and for forming the folded towels into stacks.

SUMMARY AND OBJECTS OF INVENTION

Primary objects of the invention are to provide a machine which is capable of either quarter or French folding towels, or the like, and which will handle towels of widely varying widths and/or thicknesses. Another important object is to provide means for minimizing sliding friction between the towels and forms around which they are longitudinally folded.

The invention may be summarized as including, and an important object is to provide an apparatus which includes: two laterally spaced, generally horizontal, elongated forms; a conveyor belt seated on and extending longitudinally of the forms and adapted to slide a towel longitudinally along the forms with one or both longitudinal sides of the towel depending from the forms, depending on whether the towel is to be quarter or French folded; a first diagonal blade below the forms for folding one depending longitudinal side of the towel upwardly during either quarter or French folding of the towel; a second diagonal blade below and downstream from the first, and oriented oppositely to the first, for folding upwardly an opposite depending longitudinal side of the towel during French folding thereof; means for moving one of the forms transversely toward and away from the other to adjust the machine for towel width and/or for French and quarter folding; and means for cross folding the longitudinally folded towel, whether quarter or French folded.

An important object is to provide a machine of the foregoing nature wherein the forms are longitudinally corrugated to minimize sliding friction between the forms and the towel as it is slidably propelled along the forms by the conveyor belt seated thereon.

A further object is to provide a second conveyor belt below the downstream ends of the forms, and extending longitudinally thereof, for displacing the lowermost upwardly folded, longitudinal side of the towel in the downstream direction, a related object being to provide means for driving such second conveyor at a higher speed than the first to avoid tapered folding of the towel.

Still another important object is to provide alternatively usable inlet guide means at the inlet end of the forms and the conveyor belt seated thereon, for guiding a towel between the forms and the conveyor belt in a laterally offset position for quarter folding, or a laterally centered position for French folding.

Still another important object is to provide a cross folding means which includes a lower cross folding belt, an upper cross folding belt mounted for floating vertical movement relative to the lower to accommodate towels of widely varying thicknesses, and a cross folding blade for inserting the transverse midportion of a longitudinally folded towel between the cross folding belts.

Another object is to provide a machine which includes means for stacking the longitudinally and cross folded towels, whether quarter or French folded.

The foregoing objects, advantages, features and results of the present invention, together with various other objects, advantages, features and results thereof which will be evident to those skilled in the towel folding art in the light of this disclosure, may be achieved with the exemplary embodiment of the invention which is illustrated in the accompanying drawings and described in detail hereinafter.

Figures 1, 2, 3, 4:
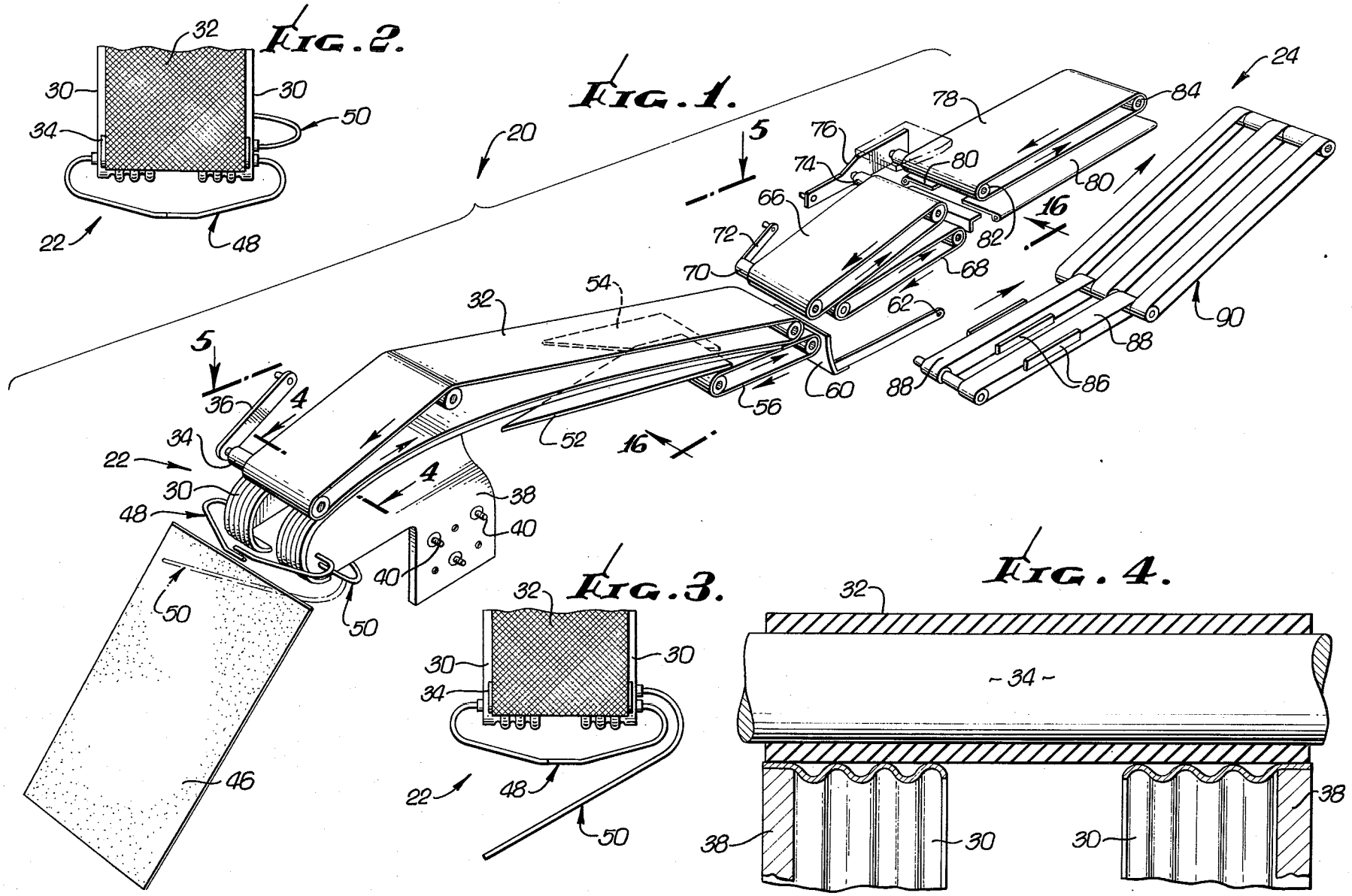
FIG. 1 is a semidiagrammatic perspective view of a towel folder which embodies the invention.
FIG. 2 is a fragmentary plan view of the inlet end of the towel folder of the invention showing an inlet guide means for French folding in operative position.
FIG. 3 is a view similar to FIG. 2, but showing an inlet guide means for quarter folding in operative position.
FIG. 4 is an enlarged, fragmentary sectional view taken as indicated by the arrowed line 4—4 of FIG. 1.

Preliminarily, it should be pointed out that in many of the views in the drawings, vertical thicknesses and spacings have been exaggerated for clarity, this being particularly true of FIGS. 4, 6, 7, 11 to 13 and 16 to 18.

DETAILED DESCRIPTION OF EXEMPLARY EMBODIMENT OF INVENTION

The towel folder of the invention is designated generally by the numeral 20 in FIG. 1 of the drawings and includes inlet and outlet ends 22 and 24. As will be explained in detail hereinafter, towels are inserted into the machine 20 at its inlet end 22 manually. The apparatus 20 either quarter or French folds the towels, depending on how the machine is adjusted and depending on how the towels are inserted thereinto. The folded towels, whether quarter or French folded, are discharged from the outlet end 24 of the machine 20 in stacks.

The towel folder 20 includes a main frame 26 comprising, among other elements, two transversely spaced, vertical plates 28 extending longitudinally of the machine. Between the plates 28 at the inlet end 22 of the machine 20, and extending downstream from such inlet end, are two generally horizontal, upwardly convex, laterally spaced forms 30 along which towels slide in the downstream direction while being longitudinally folded, as will be described. The forms 30 are longitudinally corrugated, as perhaps best shown in FIG. 4. With this construction, sliding friction is minimized, which is an important feature.

Towels are propelled longitudinally along the forms 30 in the downstream direction by a conveyor belt 32 having its lower run seated on and in slideable engagement with the upper surfaces of the forms 30. The fact that the forms 30 are upwardly convex in the longitudinal direction insures positive sliding engagement between the lower run of the conveyor belt 32 and the upper surfaces of the forms. Consequently, when a towel is inserted between the forms 30 and the conveyor belt 32, as will be described, positive sliding displacement of the towel longitudinally of the forms in the downstream direction is assured.

The conveyor belt 32 is trained around rollers, including an upstream or inlet roller 34. As shown in FIG 1, the ends of this inlet roller are mounted on pivoted arms 36 carried by the main frame 26. With this construction, the inlet end of the conveyor belt 32 can float vertically to facilitate insertion of the leading end of a towel between the conveyor belt and the forms 30.

Figure 6:
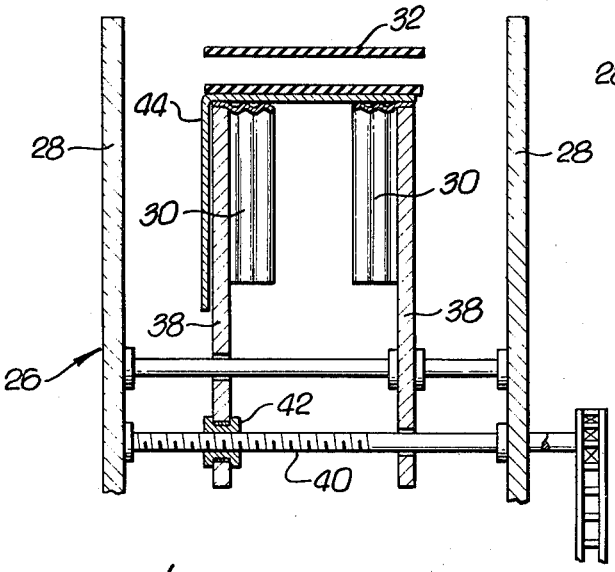
FIGS. 6 and 7 are fragmentary transverse sectional views respectively taken as indicated by the arrowed lines 6—6 and 7—7 of FIG. 5.
Figure 7:
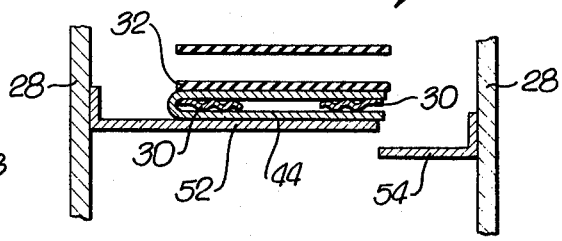
Figure 9:
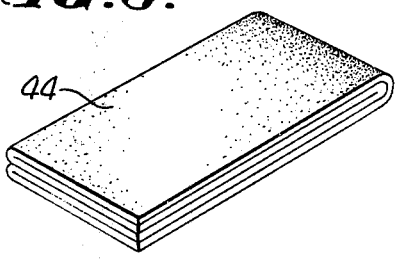
FIG. 9 is a perspective view of a towel which has been quarter folded by the machine.
Figure 8:
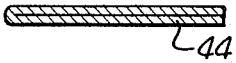
FIG. 8 is a transverse sectional view of a longitudinally folded towel prepared for quarter folding by the machine of the invention.
Figure 11:
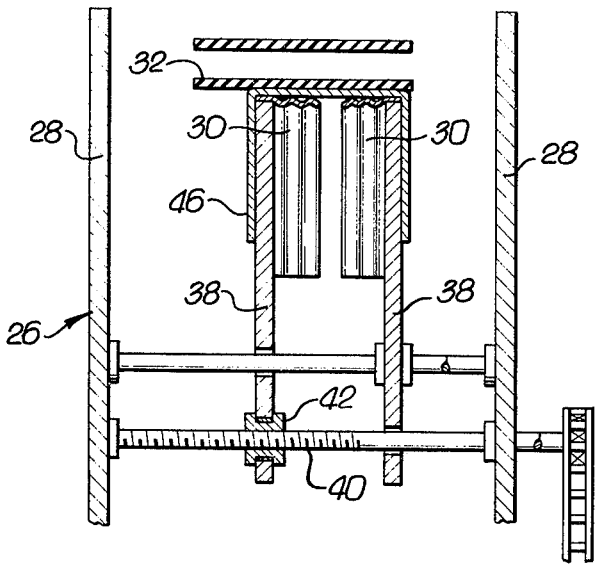
FIGS. 11, 12 and 13 are fragmentary sectional views respectively taken as indicated by the arrowed lines 11—11, 12—12, and 13—13 of FIG. 10.

The forms 30 are respectively carried by auxiliary frame plates 38 parallel to and disposed between the main frame plates 28, as best shown in FIGS. 6 and 11. The auxiliary plates 38 are carried by transverse rods extending between the main plates 28. One of these rods, i.e., the rod 40, is threaded and carries a nut 42 connected to one of the auxiliary plates 38. As will be apparent, by rotating the threaded rod 40, the lateral spacing between the forms 30 can be varied, as will be clear from a comparison of FIGS. 6 and 11, one of the forms 30 thus being fixed and the other being laterally movable to vary the lateral spacing between the two forms. With the spacing of the forms 30 shown in FIG. 6, the machine 20 is adjusted for quarter folding of a towel 44 of a particular width, the outer edges of the forms being spaced apart one-half the towel width. With the form spacing shown in FIG. 11, the machine 20 is adjusted for French folding of a towel 46 of a particular width, the outer edges of the forms being spaced one-third the towel width. As shown in FIG. 6, one longitudinal half of the towel 44 being quarter folded depends from the forms 30, the other longitudinal half being disposed between the forms and the conveyor belt 32. As shown in FIG. 11, a towel 46 being French folded is divided into longitudinally extending thirds, the central third being disposed between the forms 30 and the conveyor belt 32, and the edge thirds depending from the forms 30 on opposite sides thereof.

Figure 10:
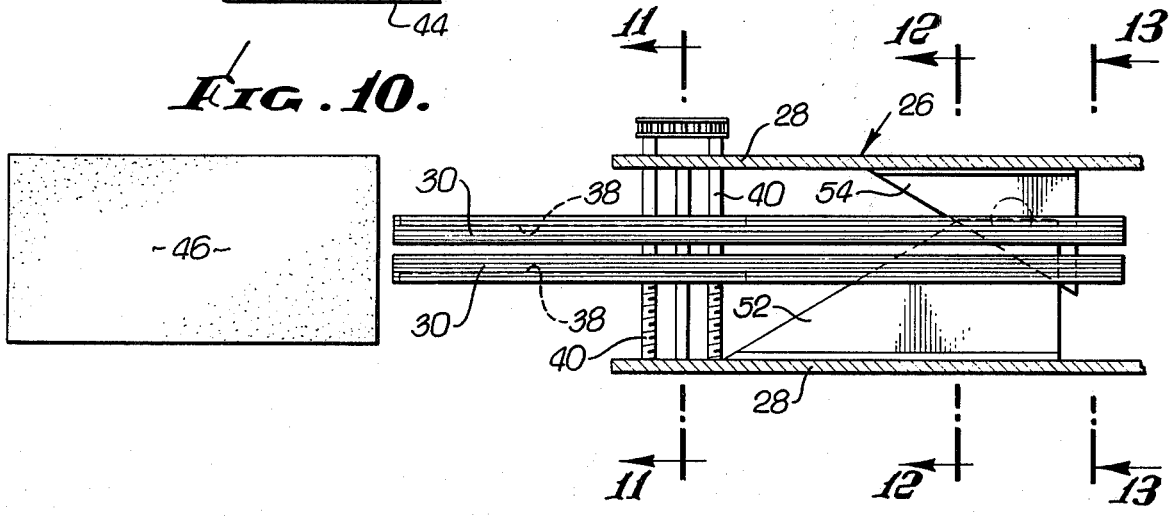
FIG. 10 is a view similar to FIG. 5, but showing the machine adjusted for French folding.

FIGS. 1 and 10 show a towel 46 to be French folded being inserted into the apparatus 20 at its inlet end 22, between the forms 30 and the conveyor belt 32. As will be apparent, the towel 46 is inserted in a laterally centered position. To assist in maintaining the towel 46 in such a laterally centered position, an inlet guide or guide means 48 is mounted on the auxiliary frame plates 38 upstream from the inlet ends of the forms 30. This inlet guide means 48 has the general configuration of a trapezoid with the shorter of its two parallel sides upstream from the longer. As will be apparent, a towel 46 to be French folded drapes itself over the inlet guide means 48 in such a way that the inlet guide means tends to center the towel. It is thought this will be clear from FIGS. 1 and 2 of the drawings.

Figure 5:
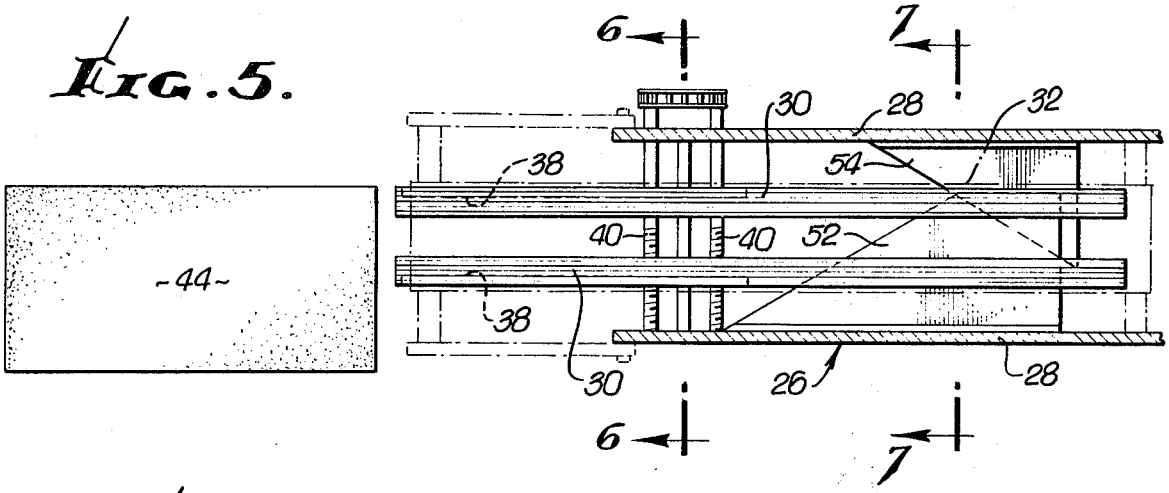
FIG. 5 is an enlarged, fragmentary plan view, with some parts in phantom, taken as indicated by the arrowed line 5—5 of FIG. 1, the machine being shown adjusted for quarter folding.

FIG. 5 of the drawings shows that a towel 44 to be quarter folded is inserted between the forms 30 and the conveyor belt 32 in a laterally offset position, with the forms 30 adjusted to a wider lateral spacing. This lateral offset of the towel 44 is such as to produce the condition hereinbefore discussed in conjunction with FIG. 6 of the drawings. Another inlet guide 50, best shown in FIG 3, supports a towel 44 to be quarter folded in such a way that the desired lateral offset of the towel is obtained. The inlet guide 50, as best shown in FIG. 3, comprises a diagonally oriented rod which serves to tend to slide a towel 44 to be quarter folded to the right, in the particular construction illustrated, to achieve the lateral offset necessary for quarter folding. As will be clear from a comparison of FIGS. 1 and 2 with FIG. 3, the inlet guide 50 is pivotally mounted on one of the auxiliary plates 38 so that it can be swung downwardly and forwardly out of the way, as shown in FIGS. 1 and 2, when French folding towels.

It will be noted that the towel 46 to be French folded, or the towel 44 to be quarter folded, is inserted directly between the forms 30 and the conveyor belt 32 without any necessity for placing the towel on any inlet or feed conveyor. In other words, the inlet end of the towel folder 20 is formed directly by the inlet or upstream ends of the forms 30 and the conveyor 32, thereby permitting manual "snap feeding" of the towel directly into the folding apparatus.

Figure 12:
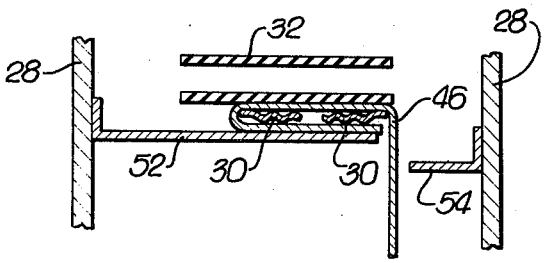

As best shown in FIGS. 1, 5 and 10, located below the forms 30 adjacent the downstream ends thereof is a diagonal folding blade 52 carried by one of the main plates 28 and cooperating with that one of the forms 30 which is laterally movable. The upstream or leading edge of the folding blade 52 extends toward the opposite main plate 28 in the downstream direction. As will be clear from FIG. 7, the diagonal folding blade 52 folds the depending half of a towel 44 being quarter folded upwardly beneath the forms 30. Also, as shown in FIG. 12, the diagonal folding blade 52 folds one of the depending thirds of a towel 46 being French folded upwardly against the forms 30.

Figure 13:
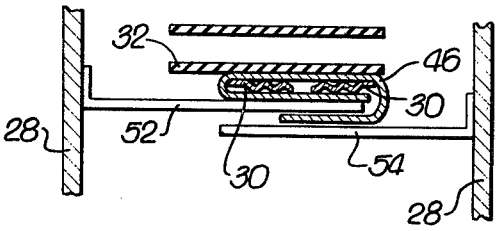
Figure 15:
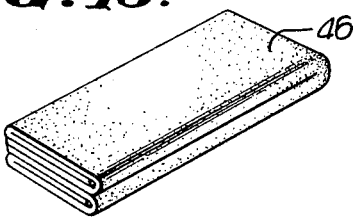
FIG. 15 is a perspective view of a towel which has been French folded by the machine.
Figure 14:
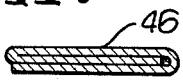
FIG. 14 is a sectional view of a longitudinally folded towel prepared for French folding by the machine of the invention.
Figure 18:
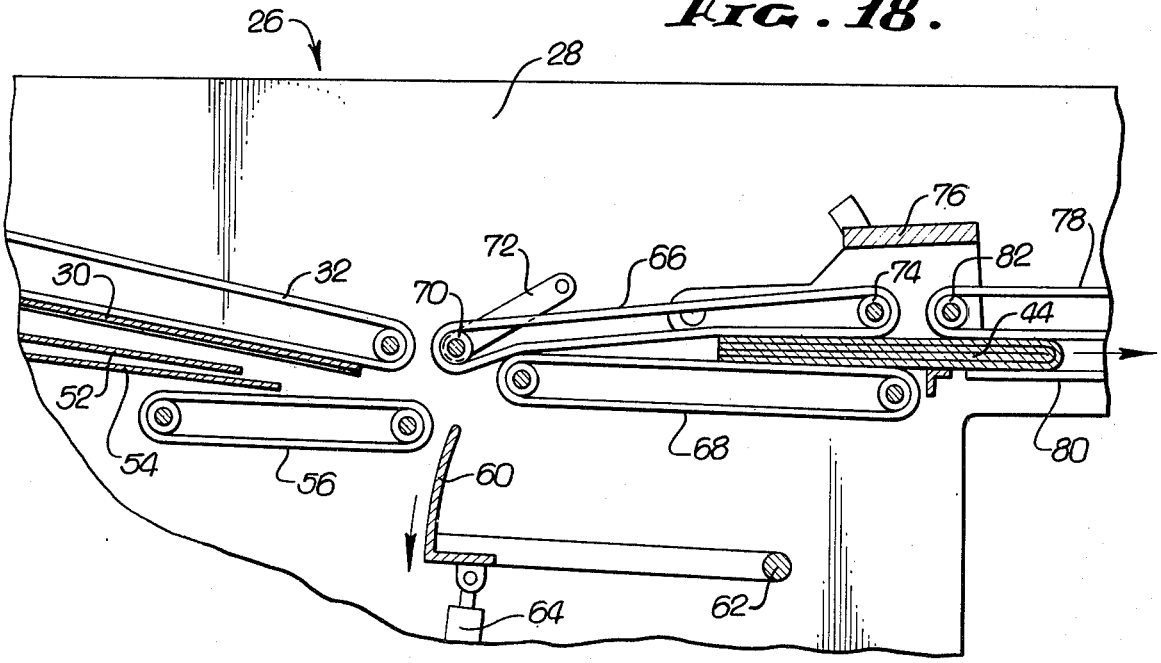
FIG. 18 is a view similar to FIGS. 16 and 17, but showing the towel after cross folding.

Below and downstream from the folding blade 52 is another diagonal folding blade 54 carried by the opposite main plate 28 and oriented oppositely to the folding blade 52 and cooperating with that one of the forms 30 which is not laterally movable, i.e., the one which is fixed. The folding blade 54 has no effect on a towel 44 being quarter folded. However, as shown in FIG. 13, the folding blade 54 folds the second depending third of a towel 46 being French folded upwardly under the first folding blade 52. (As previously explained, thicknesses and spacings in the vertical direction are somewhat exaggerated in figures such as FIG. 13. In actual practice, a towel 46 being French folded is neatly folded into thirds, as shown in FIG. 14.)

Figure 16:
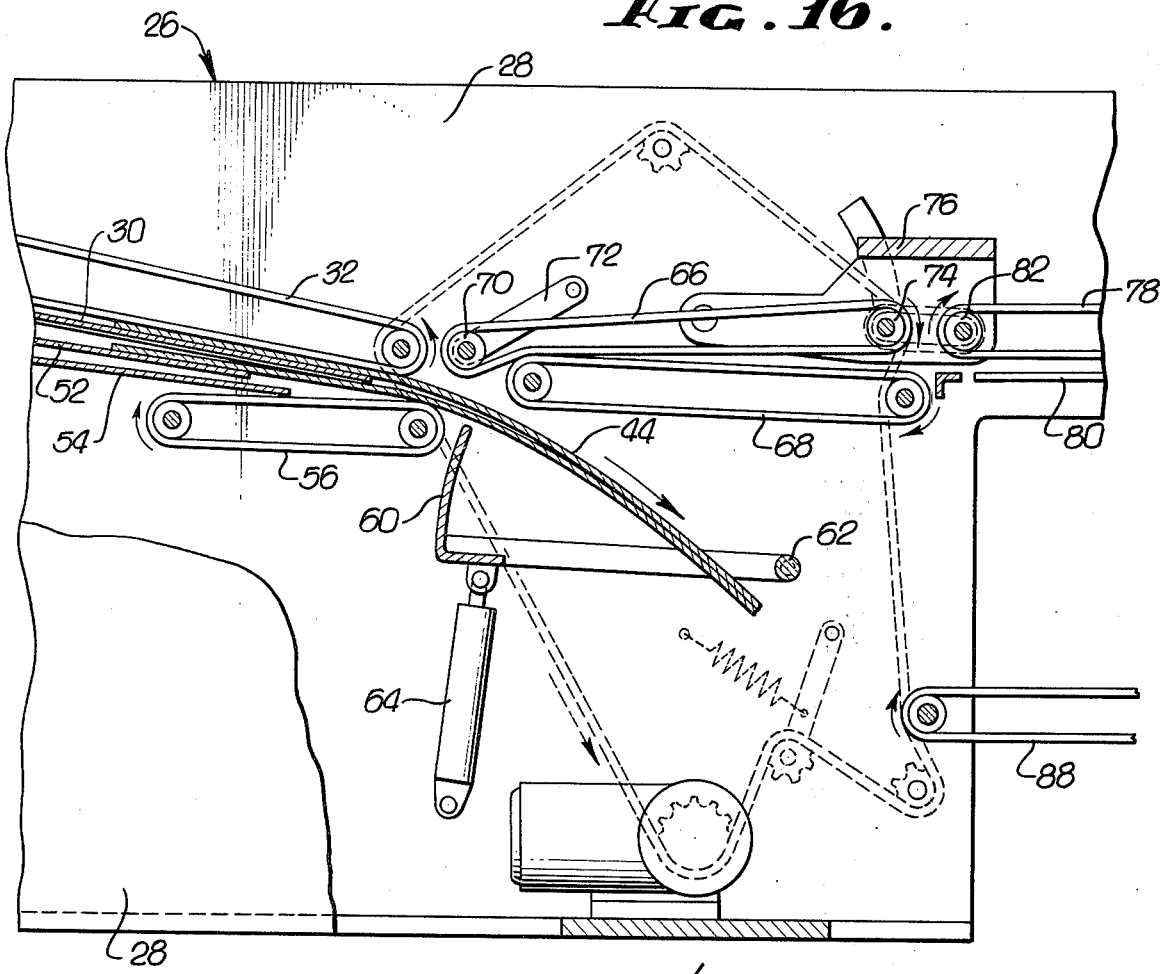
FIG. 16 is an enlarged, fragmentary sectional view taken as indicated by the arrowed line 16—16 of FIG. 1, and showing a towel which has been folded longitudinally in accordance with the invention.

Below the downstream ends of the forms 30, the conveyor belt 32 and the folding blades 52 and 54 is a lower conveyor belt 56 which, as suggested in FIGS. 16 and 17, engages the lowermost upwardly folded longitudinal portion of either the towel 44 being quarter folded, or the towel 46 being French folded. This lower conveyor belt 56 assists the upper conveyor belt 32 in propelling the longitudinally folded towel 44 or 46 past the downstream ends of these conveyor belts, as shown in FIG. 16. To prevent longitudinally tapered folding, the lower conveyor belt 56 is driven, by means not specifically shown, at a slightly higher speed than the upper conveyor belt 32. This insures that the longitudinally folded portions of the towels 44 and 46 will all be parallel.

Figure 17:
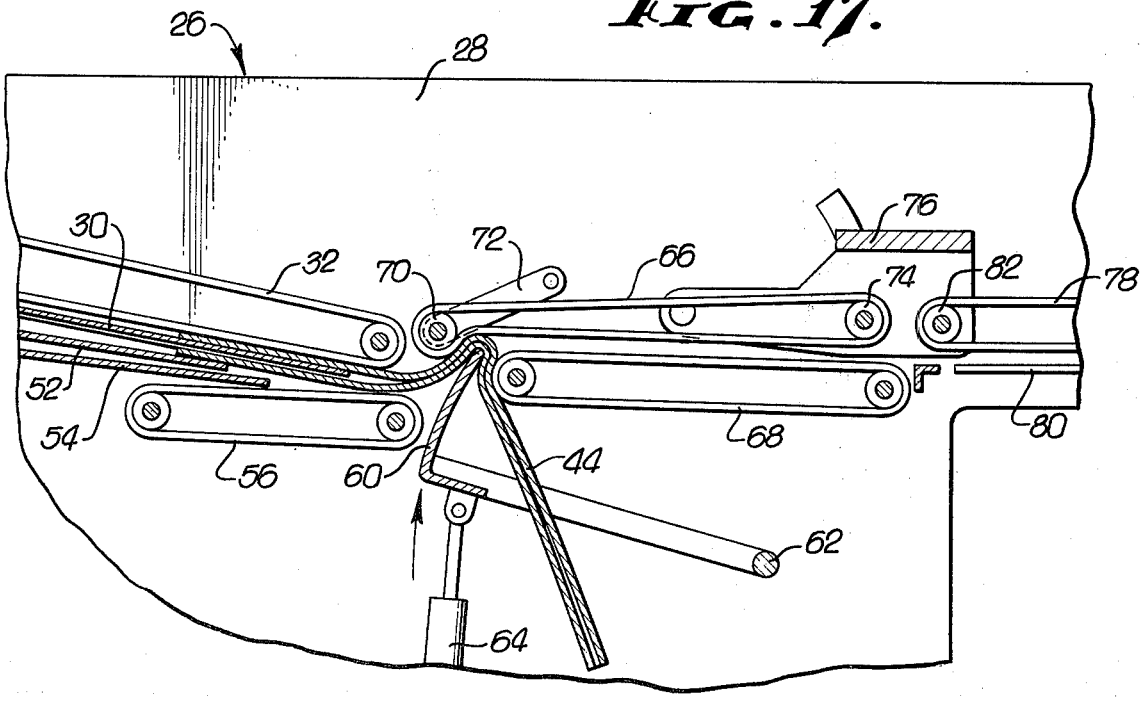
FIG. 17 is a view similar to FIG. 16, but showing the longitudinally folded towel being cross folded.

Referring to FIGS. 1 and 16 to 18, just downstream from the downstream ends of the conveyor belts 32 and 56 is an upwardly movable cross folding blade 60 pivoted on the frame 26 at 62 and actuated by a cylinder 64. When the longitudinal midsection of a longitudinally quarter folded or French folded towel 44 or 46 reaches a position just above the cross folding blade 60, the cylinder 64 is actuated by a suitable sensor, such as a photoelectric cell, not shown. The cross folding blade 60 then inserts the longitudinal midpoint of the longitudinally folded towel between upper and lower cross folding conveyor belts 66 and 68, as shown in FIG. 17. To accommodate either a quarter folded towel 44 or a French folded towel 46, or folded towels otherwise differing in thicknesses, the entire upper conveyor belt 66 floats vertically. To achieve this, an upstream roller 70 around which the upper belt 66 is trained is carried by pivoted arms 72. A downstream roller 74 around which the upper belt 66 is trained is carried by a pivoted frame 66. As will be apparent, such pivoted supports for the rollers 70 and 74 permit the upper conveyor belt 66 to float vertically for the reason indicated.

As each quarter or French folded towel 44 or 46 emerges from between the conveyor belts 66 and 68, it passes between an upper conveyor belt 78 and two downwardly opening trap doors 80. It will be noted that the belt 78 is trained around an upstream roller 82 also carried by the pivoted frame 76 so that it can float vertically to accommodate varying towel thicknesses. A downstream roller 84 around which the belt 78 is also trained is similarly mounted for vertical floating movement in a manner not specifically shown.

As each quarter or French folded towel 44 or 46 reaches a position wherein it is fully supported by the trap doors 80, a suitable sensor, not shown, stops the belt 78 and opens the trap doors 80 to drop the towel onto towel stack supports 86, FIG. 1. When the stack contains the desired number of towels, the stack supports 86 are lowered so that takeaway conveyor belts 88 can deliver the stack to a takeaway conveyor 90.

It is believed that the over-all operation of the towel folder 20 will be clear from the foregoing so that it need not be explained further herein. Although an exemplary embodiment of the invention has been disclosed for purposes of illustration, it will be understood that various changes, modifications and substitutions may be incorporated in such embodiment without departing from the spirit of the invention as defined by the claims appearing hereinafter.

We claim as our invention:

1. In a towel folder or the like, the combination of:

a. a first pair of spaced apart frame plates; a second pair of spaced apart frame plates mounted between said first pair of plates;

b. at least two rods connected to said first pair of plates, at least one of said rods having a threaded portion and being rotatably connected to said first pair of plates, said rod with a threaded portion having a first plate of said second pair mounted thereto and movable therealong, the second plate of said second pair being fixedly mounted to another of said rods;

c. means connected to said rotatable rod for rotating said rod and thereby spacing the first and second plates of said second pair of plates;

d. two elongated generally horizontal forms, each form attached to a plate of the second pair of plates, the form attached to said first plate of said second pair being movable therewith thereby determining the distance between said spaced forms;

e. a conveyor belt seated on and extending longitudinally of said forms and adapted to slide a towel longitudinally along said forms with at least one longitudinal side of said towel depending from said forms;

f. means positioned beneath said forms and supported by at least one plate of said first pair of frame plates for folding the depending longitudinal side of the towel upwardly; and g. means supported by said first pair of frame plates for cross folding the longitudinally folded towel.

2. In a towel folder, or the like as claimed in claim 1, including guide means connected to said first pair of frame plates and forming generally a geometric trapezoid when seen in a plan view for centering a towel for French folding prior to the towel sliding along said horizontal forms.

3. In an apparatus for folding towels, or the like the combination of:

a. a supporting structure carrying two laterally spaced, elongated forms having inlet and outlet ends;

b. a conveyor belt carried by said supporting structure and seated on and extending longitudinally of said forms and adapted to slide a towel longitudinally along said forms, from their input end toward their output end, with at least one side of the towel depending from the corresponding form;

c. one of said forms being fixedly connected to said supporting structure and the other being mounted on said supporting structure for lateral movement relative to said one form to vary the spacing between said forms;

d. means for laterally moving said other form relative to said one form to vary the spacing between said forms;

e. a first blade fixedly carried by said supporting structure below said one form for folding a corresponding depending side of the towel upwardly;

f. a second blade fixedly carried by said supporting structure below said other form for folding upwardly a corresponding depending side of a towel;

g. said first and second blades having first and second diagonal edges which face generally inwardly toward each other and which converge in the downstream direction; and h. said second diagonal edge being long as compared to said first diagonal edge to accommodate lateral movement of said other form relative to said second blade.

4. An apparatus as defined in claim 3 wherein said second blade is upstream of said first blade.

5. An apparatus according to claim 4 wherein said second blade is between said first blade and said forms.

* * * * *